US007823530B2

(12) United States Patent
Lee et al.

(10) Patent No.: US 7,823,530 B2
(45) Date of Patent: Nov. 2, 2010

(54) ADJUSTABLE FILM APPLICATOR

(75) Inventors: Kueir-Rarn Lee, Taoyuan (TW); Juin-Yih Lai, Taoyuan (TW); Se-Tsung Kao, Taoyuan (TW)

(73) Assignee: Chung Yuan Christian University, Tao-Yuan (TW)

( * ) Notice: Subject to any disclaimer, the term of this patent is extended or adjusted under 35 U.S.C. 154(b) by 462 days.

(21) Appl. No.: 11/965,647

(22) Filed: Dec. 27, 2007

(65) Prior Publication Data

US 2009/0165707 A1 Jul. 2, 2009

(51) Int. Cl.
*B05C 11/02* (2006.01)

(52) U.S. Cl. ..... 118/108; 118/100; 118/200; 404/99; 404/100; 404/109; 404/266

(58) Field of Classification Search ..... 118/100, 118/200; 404/99, 100, 109, 266
See application file for complete search history.

(56) References Cited

U.S. PATENT DOCUMENTS 4,821,672 A * 4/1989 Bruno ..... 118/261
5,185,926 A * 2/1993 Locke ..... 30/43.92
5,328,511 A 7/1994 Beisswanger
2002/0172771 A1* 11/2002 Damrau ..... 427/355
2005/0276451 A1* 12/2005 Hunking et al. ..... 382/110
2007/0151511 A1* 7/2007 Northrup et al. ..... 118/100

FOREIGN PATENT DOCUMENTS

TW 299286 3/1997
TW 200534957 11/2005

* cited by examiner

*Primary Examiner*—Parviz Hassanzadeh
*Assistant Examiner*—Albert Hilton
(74) *Attorney, Agent, or Firm*—WPAT, PC; Justin King

(57) ABSTRACT

The present invention discloses an adjustable film applicator which comprises an applicator body, a first knife, a second knife, a first fixing apparatus, a second fixing apparatus, a pair of first adjusting screws, and a pair of second adjusting screws. The first and second knife are adjusted to a first and second height by adjusting the first and second adjusting screws, wherein the second height is greater than the first height.

8 Claims, 6 Drawing Sheets

ADJUSTABLE FILM APPLICATOR

BACKGROUND OF THE INVENTION

1. Field of the Invention

The present invention generally relates to a film applicator, in particular to a film applicator for simultaneously forming multiple layers of film.

2. Description of the Prior Art

The conventional fixed-gate applicators comprise two parallel supportive devices and a fixed knife connecting the supportive devices. When moving, the applicator forms a film with specific thickness on the substrate by scrapping off excessive fluidic film solution and pushing it to other areas of the substrate surface.

The choice of a suitable applicator generally depends on the characters of the film material such as color, transparency, gloss, elasticity, hardness, weatherability, chemical resistance . . . etc. Therefore, when multiple layer structure of thin film is desired, it is often needed to use a number of different film applicators.

Thus, a film applicator able to simultaneously form multiple layers of thin film is desired for industrial usage.

SUMMARY OF THE INVENTION

Therefore, in accordance with the previous summary, objects, features and advantages of the present disclosure will become apparent to one skilled in the art from the subsequent description and the appended claims taken in conjunction with the accompanying drawings.

The present invention discloses an adjustable film applicator to overcome the disadvantages of the conventional techniques.

One feature of the present invention is to provide an adjustable film applicator which can simultaneously form multiple layers of thin film with varying thickness/material.

The disclosed film applicator comprises an applicator body, a first knife, a second knife, a first fixing apparatus, a second apparatus, a pair of first adjusting screws, and a pair of second adjusting screws.

The applicator body comprises a platform and a pair of foot planks, wherein the platform has a slot parallel to the longer edge of the platform, the foot planks are set under the two shorter edges of the platform.

Each of the foot planks has, on its inner side surface, a front groove and a rear groove, wherein a line connecting the grooves on individual foot planks runs parallel with the longer edge of the platform. The first and second knife are set movable in the front and rear grooves, respectively. The first and second fixing apparatus are set under the platform for confining the first and second knife in the front and rear grooves.

The first and second adjusting screws are set on top of the platform and aligned with the first and second knife, respectively, for adjusting the first knife to a first height and the second knife to a second height, wherein the second height is greater the first height.

BRIEF DESCRIPTION OF THE DRAWINGS

The accompanying drawings incorporated in and forming a part of the specification illustrate several aspects of the present invention, and together with the description serve to explain the principles of the disclosure. In the drawings.

DETAILED DESCRIPTION OF THE PREFERRED EMBODIMENTS

Figure 1:
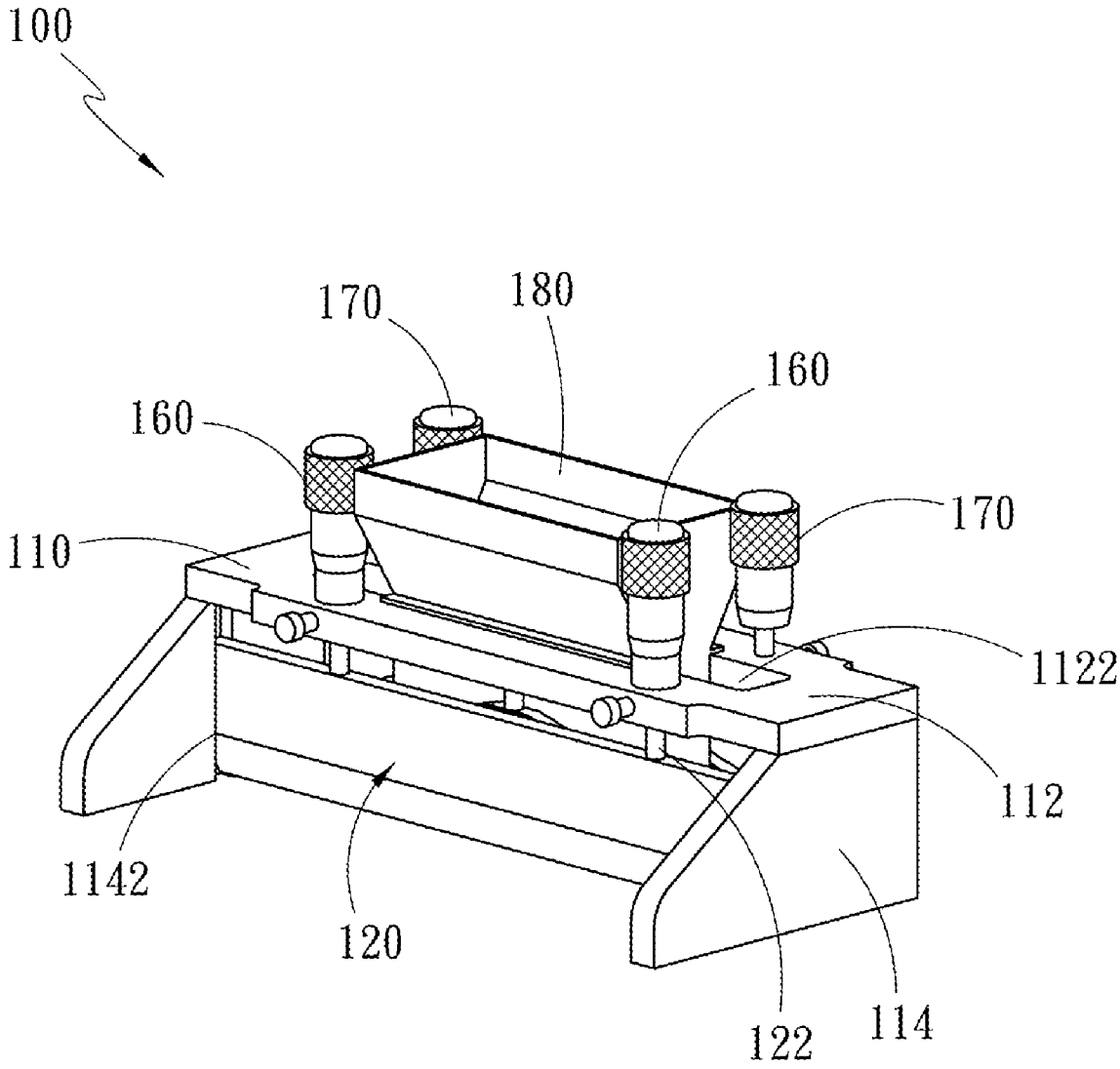
FIG. 1 is a schematic of the disclosed film applicator with the elastic fixing strip.
Figure 2:
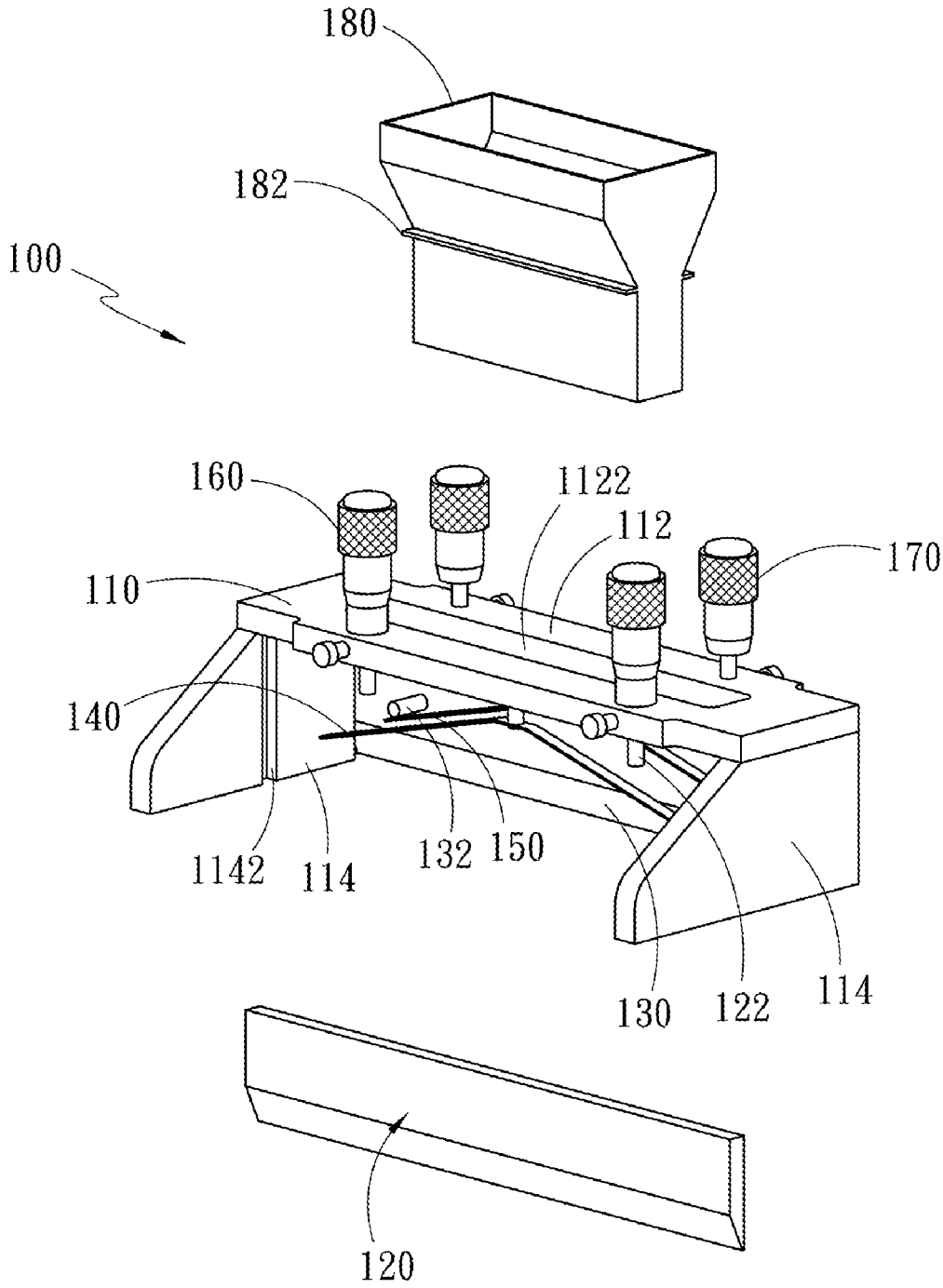
FIG. 2 is an exploded view of the disclosed film applicator with the elastic fixing strip.

The present disclosure can be described by the embodiments given below. It is understood, however, that the embodiments below are not necessarily limitations to the present disclosure, but are used to a typical implementation of the invention.

Having summarized various aspects of the present invention, reference will now be made in detail to the description of the invention as illustrated in the drawings. While the invention will be described in connection with these drawings, there is no intent to limit it to the embodiment or embodiments disclosed therein. On the contrary the intent is to cover all alternatives, modifications and equivalents included within the spirit and scope of the invention as defined by the appended claims.

It is noted that the drawings presents herein have been provided to illustrate certain features and aspects of embodiments of the invention. It will be appreciated from the description provided herein that a variety of alternative embodiments and implementations may be realized, consistent with the scope and spirit of the present invention.

It is also noted that the drawings presents herein are not consistent with the same scale. Some scales of some components are not proportional to the scales of other components in order to provide comprehensive descriptions and emphasizes to this present invention.

The film applicator moves on a substrate on whose surface the film is to be applied. When moving, the film applicator scrapes off excessive fluidic film solution and pushes it to the other area of the substrate surface, so as to form a film on the substrate with a desired thickness. The present invention discloses an adjustable film applicator with two knifes which when working simultaneously generates two layers of film, with one on top of the other.

Referring to FIG. 1, in the first embodiment of the present invention an adjustable film applicator 100 is disclosed. The disclosed film applicator 100 comprises an applicator body 110, a first knife 120, a second knife 130, a first fixing apparatus 140, a second fixing apparatus 150, a pair of first adjusting screws 160 and a pair of second adjusting screws 170. The applicator body 110 comprises a rectangular platform 112 and a pair of foot planks 114 wherein the platform 112 has a slot 1122 in the center. The slot 1122 is parallel to the longer edge of the platform 112. The foot planks 114 are set under the two shorter edges of the platform 112. As shown, each of the foot planks 114 has a vertical front and rear grooves 1142 on the inner surface. The direction of a line connecting the grooves 1142 would be parallel to the longer edge of the platform 112. The first knife 120 and second knife 130 are set movable along the front and rear grooves 1142 of the foot planks 114.

In this embodiment, the first fixing apparatus 140 and the second fixing apparatus 150 are set under the platform 112 for confining the first knife 120 and second knife 130 in the grooves 1142. A pair of first adjusting screws 160 and a pair of second adjusting screws 170 are set on top of the platform 112 and aligned with the first knife 120 and second knife 130, respectively, for adjusting the first knife to a first height and the second knife to a second height, wherein the second height is greater than the first height. This embodiment can further comprises a funnel 180, which is surrounded by supporting apparatuses 182 for setting up the funnel 180 in the slot 1122, such that the film solution can be directed to the region between the first knife 120 and second knife 130.

The disclosed adjustable film applicator can further comprise a third knife, fourth knife . . . and so on and so forth behind the second knife. The relationship between the associate height is the first height<the second height<the third height<the fourth height . . . . Through the above multi-height settings the disclosed film applicator is able to form a multi-layer film structure of more than three film layers.

Figure 3:
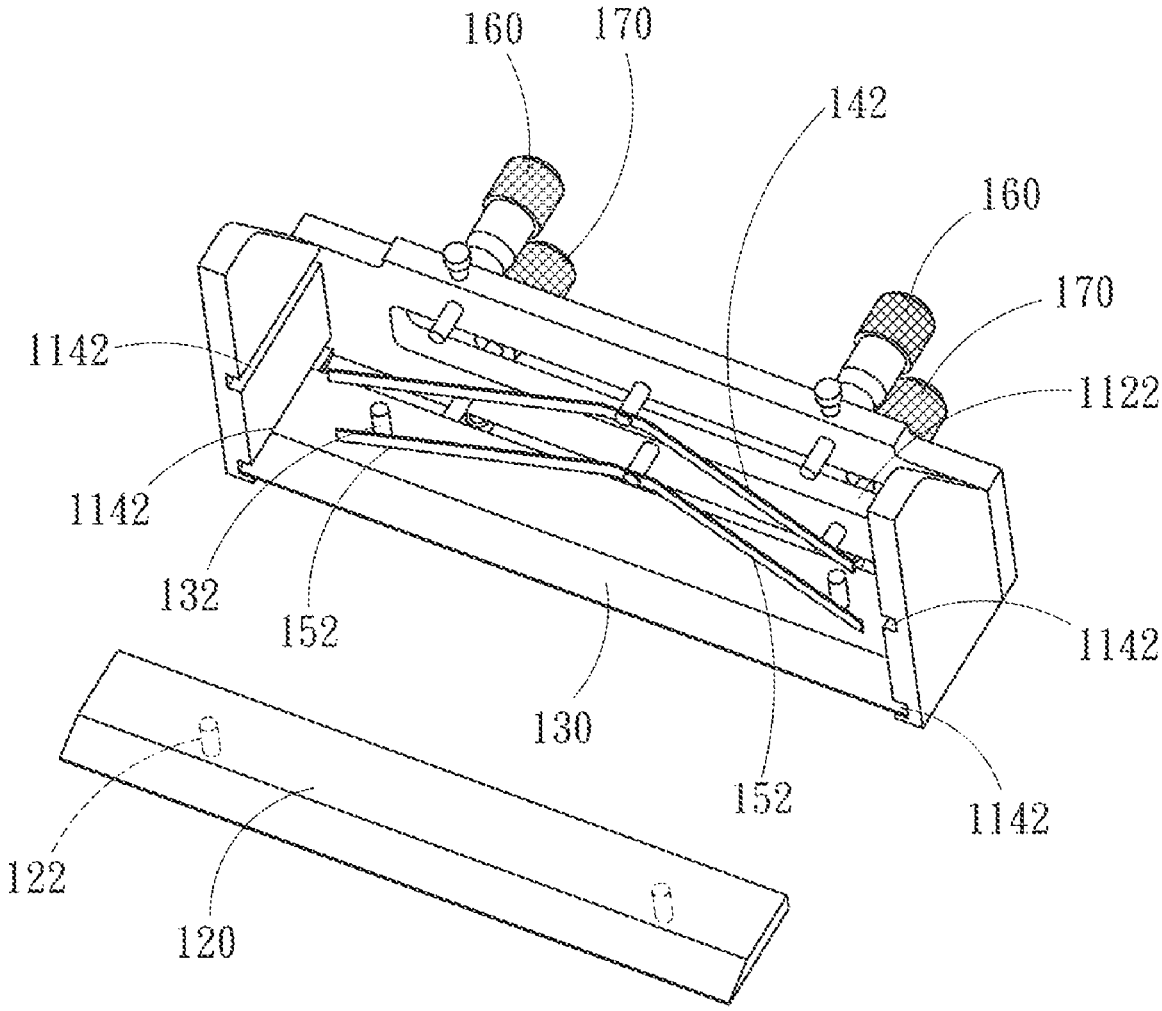
FIG. 3 is a bottom view of the disclosed film applicator with the elastic fixing strip.

Referring to FIG. 3, in a preferred example of this embodiment, the first fixing apparatus 140 is a first elastic fixing strip 142. The middle portion of the first elastic fixing strip 142 is fixed on the bottom surface of the platform 112 and ahead of the slot 1122. The two end portions of the first elastic fixing strip 142 are deformable. The first knife 120 has two protruding bodies 122 set on the blade of the first knife 120 which are perpendicular to the blade. When the end portions of the first elastic fixing strip 142 is deformed, the protruding bodies 122 are pushed upwards by the first fixing strip 142 through the resilience force of the first fixing strip 142 such that the first knife 120 is confined in the front grooves 1142 of the foot planks 114.

The second fixing apparatus 150 is a second elastic fixing strip 152. The middle portion of the second elastic fixing strip 152 is fixed on the bottom surface of the platform 112 and behind the slot 1122. The two end portions of the second elastic fixing strip 152 are deformable. The second knife 130 has two protruding bodies 132 set on the blade of the second knife 130 which are perpendicular to the blade. When the end portions of the second elastic fixing strip 152 is deformed, the protruding bodies 132 are pushed upwards by the second fixing strip 152 through the resilience force of the second fixing strip 152 such that the second knife 130 is confined in the rear grooves 1142 of the foot planks 114.

Figure 4:
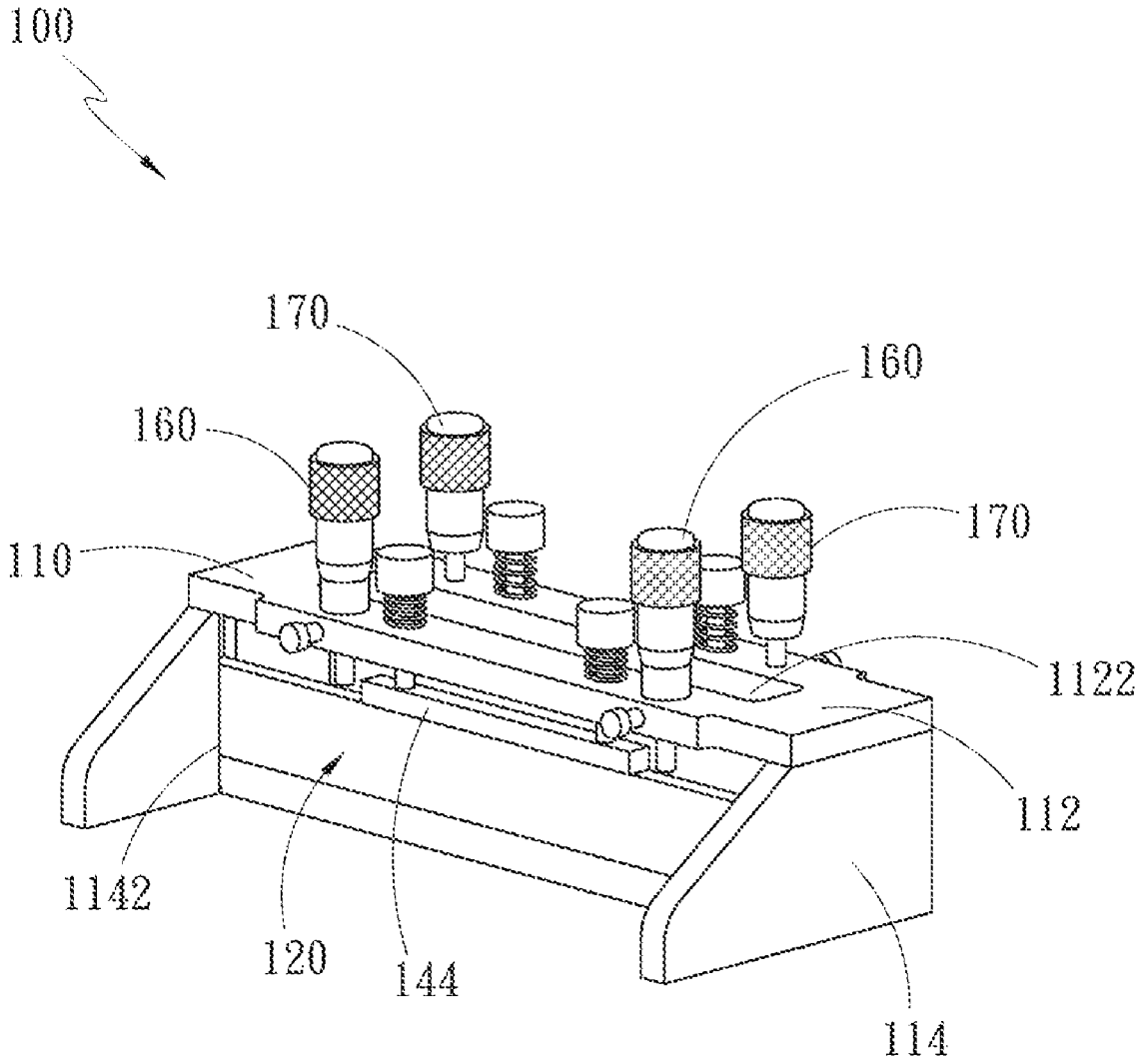
FIG. 4 is a schematic of the disclosed film applicator with the Π-shaped magnetic fixing apparatus.
Figure 5:
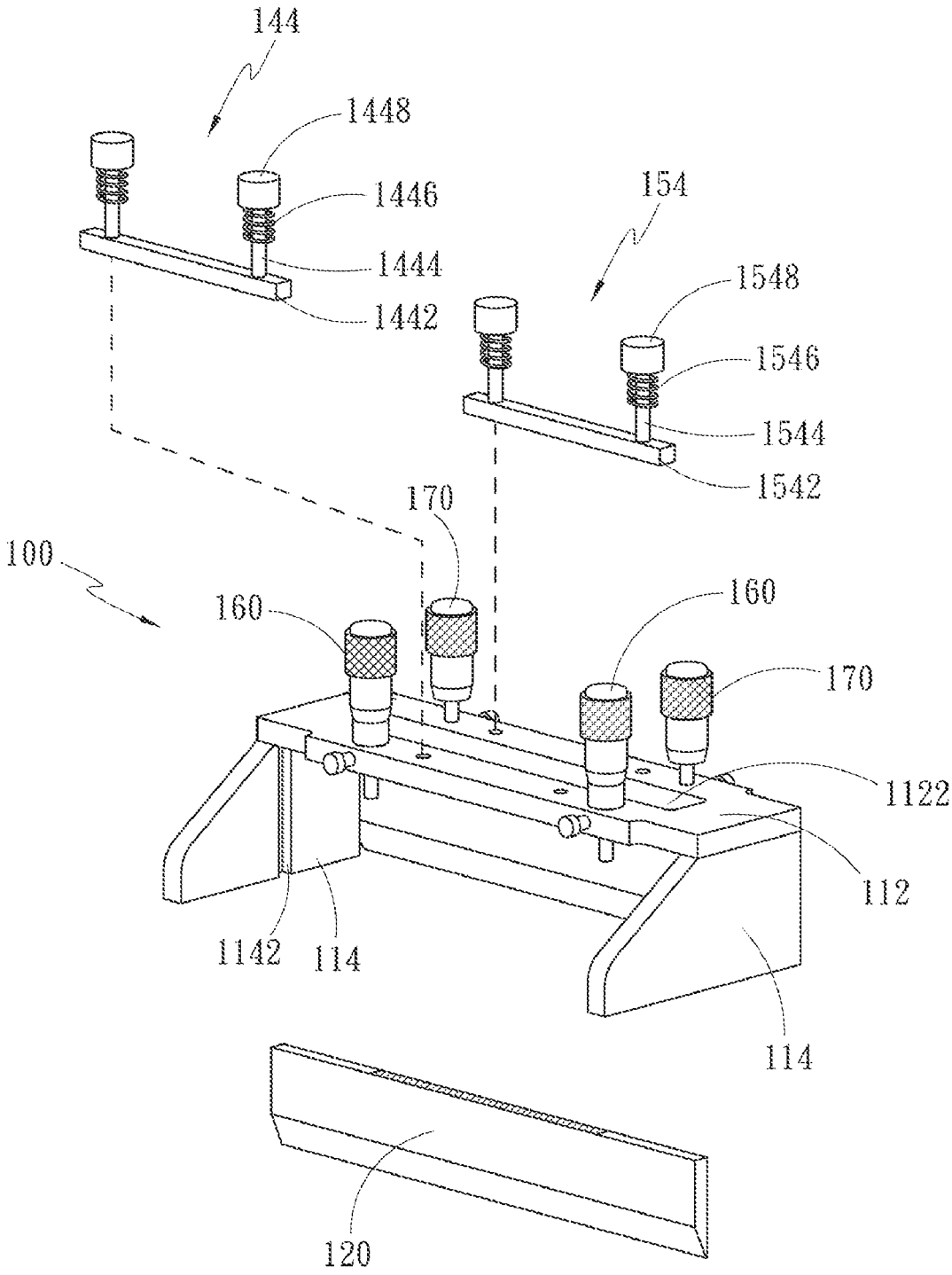
FIG. 5 is an exploded view of the disclosed film applicator with the Π-shaped magnetic fixing apparatus.

Referring to FIGS. 4 and 5, in another preferred example of this embodiment, the first fixing apparatus 140 is a first Π-shaped magnetic fixing apparatus 144 which comprises a magnetic bottom rod 1442, two short rods 1444, two springs 1446 and two nuts 1448. The magnetic bottom rod 1442 is located underneath the platform 112 and ahead of the slot 1122. The magnetic bottom rod 1442 attaches to the first knife 120 through magnetic force. One end of the short rods 1444 joins the magnetic bottom rod 1442; the other end of the short rods 1444 perforate through the platform 112, emerging from the top surface of said platform 112. Each spring 1446 slips on each above-mentioned the other end of short rods 1444. As shown in the figure, the nuts 1448 screw to compress the springs 1446 thereby adjusting the degree of deformation of the springs 1446. When the springs 1446 are deformed, the magnetic bottom rod 1442 is pulled upwards by the short rods 1444 through the resilience force of the springs 1446, which along with turning the first adjusting screws 160 enables the first knife 120 to be adjusted to a first height.

In this example, the second fixing apparatus 150 is a second Π-shaped magnetic fixing apparatus 154 which comprises a magnetic bottom rod 1542, two short rods 1544, two springs 1546 and two nuts 1548. The magnetic bottom rod 1542 is located underneath the platform 112 and behind the slot 1122. The magnetic bottom rod 1542 attaches to the second knife 130 through magnetic force. One end of the short rods 1544 joins the magnetic bottom rod 1542; the other end of the short rods 1544 perforate through the platform 112, emerging from the top surface of said platform 112. Each springs 1546 slips on each above-mentioned the other end of short rods 1544. The nuts 1548 screw to compress the springs 1546 thereby adjusting the degree of deformation of the springs 1546. When the springs 1546 are deformed, the magnetic bottom rod 1542 is pulled upwards by the short rods 1544 through the resilience force of the springs 1546, which along with turning the second adjusting screws 170 enables the second knife 130 to be adjusted to a second height.

Figure 6:
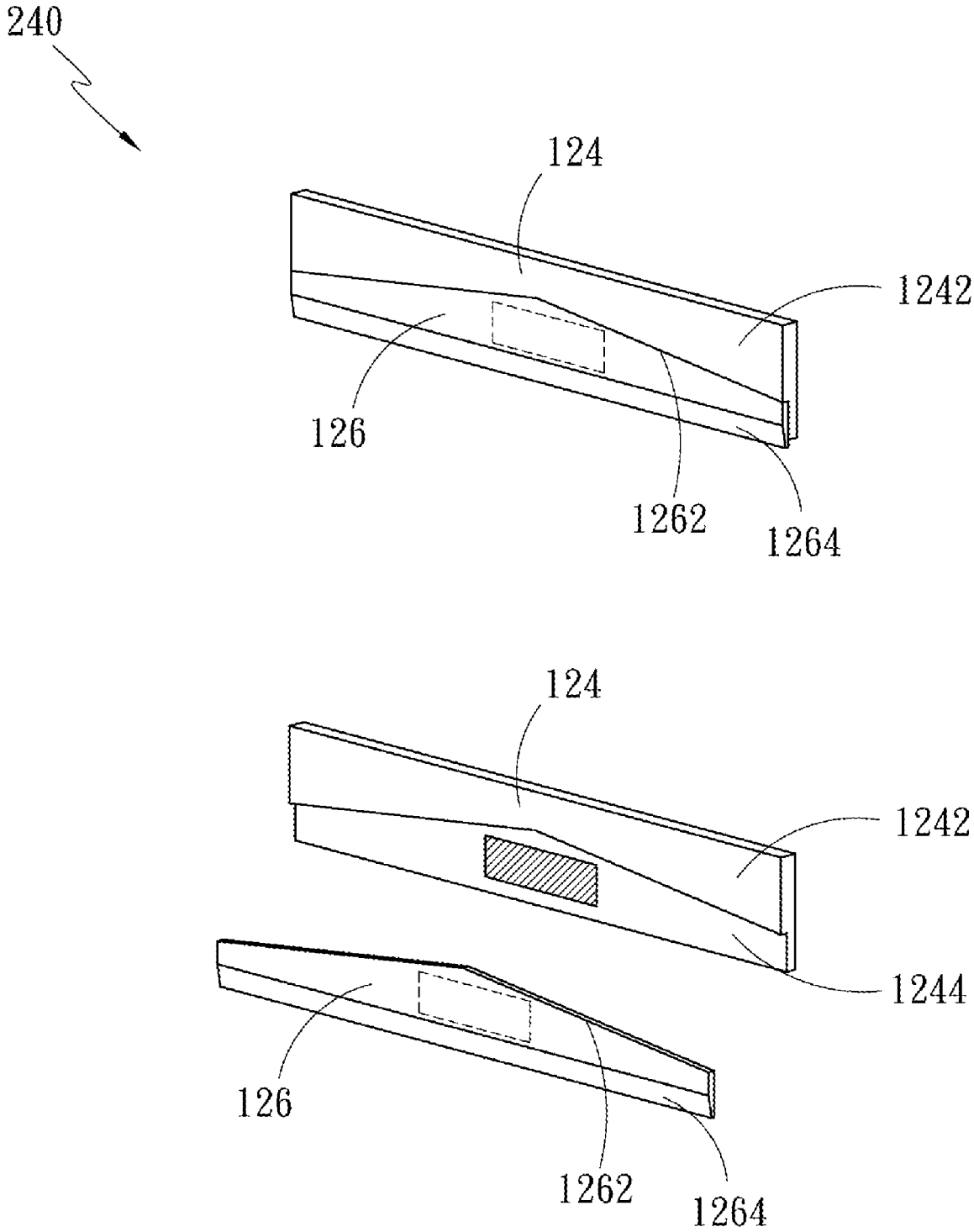
FIG. 6 is a schematic of the disclosed knife assembly.

Referring to FIG. 6, in yet another preferred example of this embodiment, the first knife 120 and the second knife 130 are a knife assembly 240. The knife assembly 240 comprises a base 124 and a blade 126 which attach to each other through magnetic force. The blade 126 comprises a V-shaped top portion 1262 and a rectangular base portion 1264. The rectangular base portion 1264 comprises two side edges and a bottom edge which is the sharp edge of the blade 126.

The base 124 has a recess for accommodating the blade 126. The base 124 comprises an upper portion 1242 and a lower portion 1244. The upper portion 1242 has a V-shaped edge which matches the V-shaped top portion 1262 of the blade 126; the lower portion 1244 is in planar contact with the blade 126. It is noted that the base 124 and blade 126 can both made of magnet so as to attach to each other through magnetic force and form the knife assembly 240. Alternatively, magnet can be set on the base 124 and blade 126 so as to form the knife assembly 240.

The foregoing description is not intended to be exhaustive or to limit the invention to the precise forms disclosed. Obvious modifications or variations are possible in light of the above teachings. In this regard, the embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the inventions as determined by the appended claims when interpreted in accordance with the breath to which they are fairly and legally entitled.

It is understood that several modifications, changes, and substitutions are intended in the foregoing disclosure and in some instances some features of the invention will be employed without a corresponding use of other features. Accordingly, it is appropriate that the appended claims be construed broadly and in a manner consistent with the scope of the invention.

The invention claimed is:

1. An adjustable film applicator, comprising:

an applicator body, said applicator body having a platform and a pair of foot planks, said platform having a slot which is parallel to the longer edge of said platform, said foot planks being set under the two shorter edges of said platform, each of said foot planks having a front and a rear groove on the inner surface thereof, the direction of said grooves being perpendicular to said platform, a line connecting said grooves on individual said foot planks being parallel to the longer edge of said platform;

a first knife and a second knife, said first knife fitting in said front grooves of said foot planks, said second knife fitting in said rear grooves of said foot planks;

a first fixing apparatus and a second fixing apparatus, said first and second fixing apparatus being set under said platform for confining said first and second knife in said front and rear grooves, respectively; and a pair of first adjusting screws and a pair of second adjusting screws, said first and second adjusting screws being set on top of said platform and aligned with said first and second knife, respectively, for adjusting the height of said first and second knife, said adjustable film applicator moving in a direction from said second knife toward said first knife;

wherein said first fixing apparatus is a first fixing strip, the middle portion of said first fixing strip is fixed on the bottom surface of said platform and ahead of said slot, the two end portions of said first fixing strip are deformable, said first knife has two protruding bodies set on the blade thereof, said protruding bodies are perpendicular to the blade, and when the two end portions of said first fixing strip is deformed, said protruding bodies are pushed upwards by said first fixing strip through the resilience force of said first fixing strip such that said first knife is confined in said front grooves of said foot planks.

2. The adjustable film applicator according to claim 1, said second fixing apparatus being a second fixing strip, the middle portion of said second fixing strip being fixed on the bottom surface of said platform and behind said slot, the two end portions of said second fixing strip being deformable, said second knife having two protruding bodies set on the blade thereof, said protruding bodies being perpendicular to the blade wherein when the two end portions of said second fixing strip is deformed, said protruding bodies are pushed upwards by said second fixing strip through the resilience force of said second fixing strip such that said second knife is confined in said rear grooves of said foot planks.

3. The adjustable film applicator according to claim 1, said first fixing apparatus being a first II-shaped magnetic fixing apparatus, said first II-shaped magnetic fixing apparatus comprising:

a magnetic bottom rod, said magnetic bottom rod being located underneath said platform and ahead of said slot, said magnetic bottom rod attaching to said first knife through magnetic force;

two short rods, one end of said short rods joining said magnetic bottom rod, the other end of said short rods perforating through said platform, emerging from the top surface of said platform;

two springs, each slipping on each said the other end of said short rods;

two nuts, said nuts screwing to compress said springs thereby adjusting the degree of deformation of said springs, wherein when said springs are deformed said magnetic bottom rod is pulled upwards by said short rods through the resilience force of said springs, which along with turning said first adjusting screws enables said first knife to be adjusted to a first height.

4. The adjustable film applicator according to claim 1, said second fixing apparatus being a second II-shaped magnetic fixing apparatus, said second II-shaped magnetic fixing apparatus comprising:

a magnetic bottom rod, said magnetic bottom rod being located underneath said platform and behind said slot, said magnetic bottom rod attaching to said second knife through magnetic force;

two short rods, one end of said short rods joining said magnetic bottom rod, the other end of said short rods perforating through said platform, emerging from the top surface of said platform;

two springs, each slipping on each said the other end of said short rods;

two nuts, said nuts screwing to compress said springs thereby adjusting the degree of deformation of said springs, wherein when said springs are deformed said magnetic bottom rod is pulled upwards by said short rods through the resilience force of said springs, which along with turning said second adjusting screws enables said second knife to be adjusted to a second height.

5. The adjustable film applicator according to claim 1, said first knife being a knife assembly, said knife assembly comprising a base and a blade, said base and blade attaching to each other through magnetic force and said blade comprising:

a V-shaped top portion; and a rectangular base portion, said rectangular base portion comprising two side edges and a bottom edge, said bottom edge being the sharp edge of said blade.

6. The adjustable film applicator according to claim 5, said base having a recess for accommodating said blade, said base comprising:

an upper portion, said upper portion having a V-shaped edge which matches said V-shaped top portion of said blade; and a lower portion, said lower portion being in planar contact with said blade.

7. The adjustable film applicator according to claim 1, said second knife being a knife assembly, said knife assembly comprising a base and a blade said base and blade attaching to each other through magnetic force and said blade comprising:

a V-shaped top portion; and a rectangular base portion, said rectangular base portion comprising two side edges and a bottom edge, said bottom edge being the sharp edge of said blade.

8. The adjustable film applicator according to claim 1, said second knife being a knife assembly, said knife assembly comprising a base and a blade, said base and blade attaching to each other through magnetic force, and said base having a recess for accommodating said blade, said base comprising:

an upper portion, said upper portion having a V-shaped edge which matches said V-shaped top portion of said blade; and a lower portion, said lower portion being in planar contact with said blade.

* * * * *